US008567197B2

(12) United States Patent
Mueller et al.

(10) Patent No.: US 8,567,197 B2
(45) Date of Patent: Oct. 29, 2013

(54) ACOUSTIC DAMPER

(75) Inventors: Mark Anthony Mueller, West Chester, OH (US); John Andrew Konkoly, Maineville, OH (US)

(73) Assignee: General Electric Company, Schenectady, NY (US)

( * ) Notice: Subject to any disclaimer, the term of this patent is extended or adjusted under 35 U.S.C. 154(b) by 971 days.

(21) Appl. No.: 12/347,959

(22) Filed: Dec. 31, 2008

(65) Prior Publication Data

US 2011/0048020 A1 Mar. 3, 2011

(51) Int. Cl.
*F02C 7/24* (2006.01)

(52) U.S. Cl.
USPC ..... 60/725; 60/722

(58) Field of Classification Search
USPC ..... 60/725, 39.02, 722, 39.01
See application file for complete search history.

(56) References Cited

U.S. PATENT DOCUMENTS

| | | | | |
|---|---|---|---|---|
| 4,529,377 A | | 7/1985 | Zinn et al. | |
| 5,575,144 A | * | 11/1996 | Brough | 60/779 |
| 5,685,157 A | | 11/1997 | Pandalai et al. | |
| 6,862,889 B2 | * | 3/2005 | Held et al. | 60/747 |
| 7,059,135 B2 | | 6/2006 | Held et al. | |
| 2002/0100281 A1 | | 8/2002 | Hellat et al. | |
| 2006/0123791 A1 | | 6/2006 | Macquisten et al. | |
| 2007/0256418 A1 | | 11/2007 | Mueller et al. | |
| 2008/0216481 A1 | * | 9/2008 | Pollarolo | 60/725 |

FOREIGN PATENT DOCUMENTS

DE 102005050029 A1 4/2007

OTHER PUBLICATIONS

International Search Report issued in connection with corresponding PCT Application No. PCT/US2009/067468 on Apr. 8, 2010.

* cited by examiner

*Primary Examiner* — Phutthiwat Wongwian
*Assistant Examiner* — Vikansha Dwivedi
(74) *Attorney, Agent, or Firm* — General Electric Company; William Scott Andes; David J. Clement

(57) ABSTRACT

An apparatus for attenuating acoustic oscillations of a gas flow contained in part by a combustor wall of a gas turbine engine combustor, wherein the combustor includes at least one air/fuel mixer, includes at least one resonating tube with a closed end and an open end and a single cavity between the ends. The tube is located on the combustor wall downstream of the air/fuel mixer.

16 Claims, 4 Drawing Sheets

ACOUSTIC DAMPER

BACKGROUND OF THE INVENTION

The technology described herein relates generally to turbomachinery, particularly to gas turbine engines, and more particularly, to an acoustic damping apparatus to control dynamic pressure pulses in a gas turbine engine combustor.

Destructive acoustic pressure oscillations or pressure pulses may be generated in combustors of gas turbine engines as a consequence of normal operating conditions depending on fuel-air stoichiometry, total mass flow, and other operating conditions. The current trend in gas turbine combustor design towards low NOx emissions required to meet federal and local air pollution standards has resulted in the use of lean premixed combustion systems in which fuel and air are mixed homogeneously upstream of the flame reaction region. The fuel-air ratio or the equivalence ratio at which these combustion systems operate are much "leaner" compared to more conventional combustors in order to maintain low flame temperatures which in turn limits production of unwanted gaseous NOx emissions to acceptable levels. Although this method of achieving low emissions without the use of water or steam injection is widely used, the combustion instability associated with operation at low equivalence ratio also tends to create unacceptably high dynamic pressure oscillations in the combustor which can result in hardware damage and other operational problems. Pressure pulses can have adverse effects on an engine, including mechanical and thermal fatigue to combustor hardware. The problem of pressure pulses has been found to be of even greater concern in low emissions combustors since a much higher content of air is introduced to the fuel-air mixers in such designs.

Aircraft engine derivative annular combustion systems with their short compact combustor design have been observed to produce complex predominant acoustic pressure oscillation modes in the combustor. The complex modes are characterized as having a circumferential mode coupled with standing axial oscillation modes between the two reflecting surfaces. Each of the two reflecting surfaces is located at an end of the combustor corresponding to compressor outer guide vanes (OGV) and a turbine nozzle inlet. This creates high dynamic pressure oscillations across the entire combustion system.

Several attempts have been made to eliminate, prevent, or diminish the acoustic pressures produced by such dynamic pressure pulses in gas turbine engine combustors. One method has been to elevate flame temperatures, which has achieved moderate success. However, elevating flame temperature is clearly contrary to the goals of low emissions in modern combustors since a relatively low temperature band is preferred. Moreover, it has been found that elevating the flame temperature in a combustor has an undesirable effect on the liners thereof.

Another proposed system has been to utilize an asymmetric compressor discharge pressure bleed. In this system, it is believed that pressure pulses in the combustor take the form of a circumferential pulse located adjacent to the combustion chamber. However, it has been found that pressure pulses within the combustor travel not only in a circumferential manner, but also in an axial manner. More specifically, pulses originating in the combustion chamber travel therein and then are reflected back through the fuel-air mixers into the cold section of the combustor. Therefore, the asymmetric compressor discharge pressure bleed has been found to be unsuccessful in effectively combating pressure pulses in the combustor.

Still another method of counteracting pressure pulses within a gas turbine engine combustor has been the use of detuning tubes positioned at the upstream side of the combustor. These detuning tubes extend into the chamber in front of the combustor by a predetermined amount and are effective at balancing out pressure pulses having a fixed amplitude and frequency. Nevertheless, it has been found that pressure pulses within a combustor are dynamic with changing amplitudes and frequencies. Thus, the aforementioned detuning tubes have met with only a moderate degree of success.

Active acoustic or pressure oscillation control systems have also been suggested to solve the problem. One such idea is disclosed in U.S. Pat. No. 5,575,144, which provides an apparatus for actively controlling dynamic pressure pulses in a gas turbine engine combustor and includes a means for sensing pressure pulses in the combustor, a first processing means for determining the amplitude and frequency for a predominant pressure pulse of the sensed pressure pulses, a second processing means for calculating an amplitude, a frequency, and a phase angle shift for a cancellation pulse to offset the predominant pressure pulse, and an air bleed means for periodically extracting metered volumes of air from the combustor to produce the cancellation pulse, wherein the air bleed means is controlled by the second processing means. Such a system is complex, has many movable parts, that are subject to wear and break down thus requiring repair or replacement. Operators and manufacturers prefer to use less complex methods.

It is highly desirable to have a static means for eliminating or reducing these high dynamic pressure oscillations in a gas turbine engine combustor particularly one that has a short length and is designed for low NOx (nitrous oxides), CO, and unburnt hydrocarbon emissions. It is also highly desirable to develop such an apparatus that can eliminate, prevent, or diminish complex mode acoustic pressure oscillations having different amplitudes and frequencies and that does not have any adverse effect on the emissions of the combustor.

BRIEF SUMMARY OF THE INVENTION

In one aspect, an apparatus for attenuating acoustic oscillations of a gas flow contained in part by a combustor wall of a gas turbine engine combustor, wherein the combustor includes at least one air/fuel mixer, includes at least one resonating tube with a closed end and an open end and a single cavity between the ends. The tube is located on the combustor wall downstream of the air/fuel mixer.

In another aspect, a combustor for a gas turbine engine disposed between a diffuser outlet downstream of a compressor outlet guide vane stage and a turbine inlet guide vane stage includes an outer casing spaced apart from an inner casing and a combustion chamber therebetween, a combustor inlet at the diffuser outlet and a combustor outlet at the turbine inlet, and an annularly disposed plurality of air/fuel mixture injectors radially disposed between the casings and axially disposed between the combustor inlet and the combustor outlet, and an annularly disposed plurality of resonating tubes disposed around the combustion chamber. Each of the tubes comprises a closed end and an open end and a single cavity between the ends. The annularly disposed plurality of resonating tubes is axially disposed between the plurality of air/fuel mixture injectors and the combustor outlet.

DETAILED DESCRIPTION OF THE INVENTION

Figure 1:
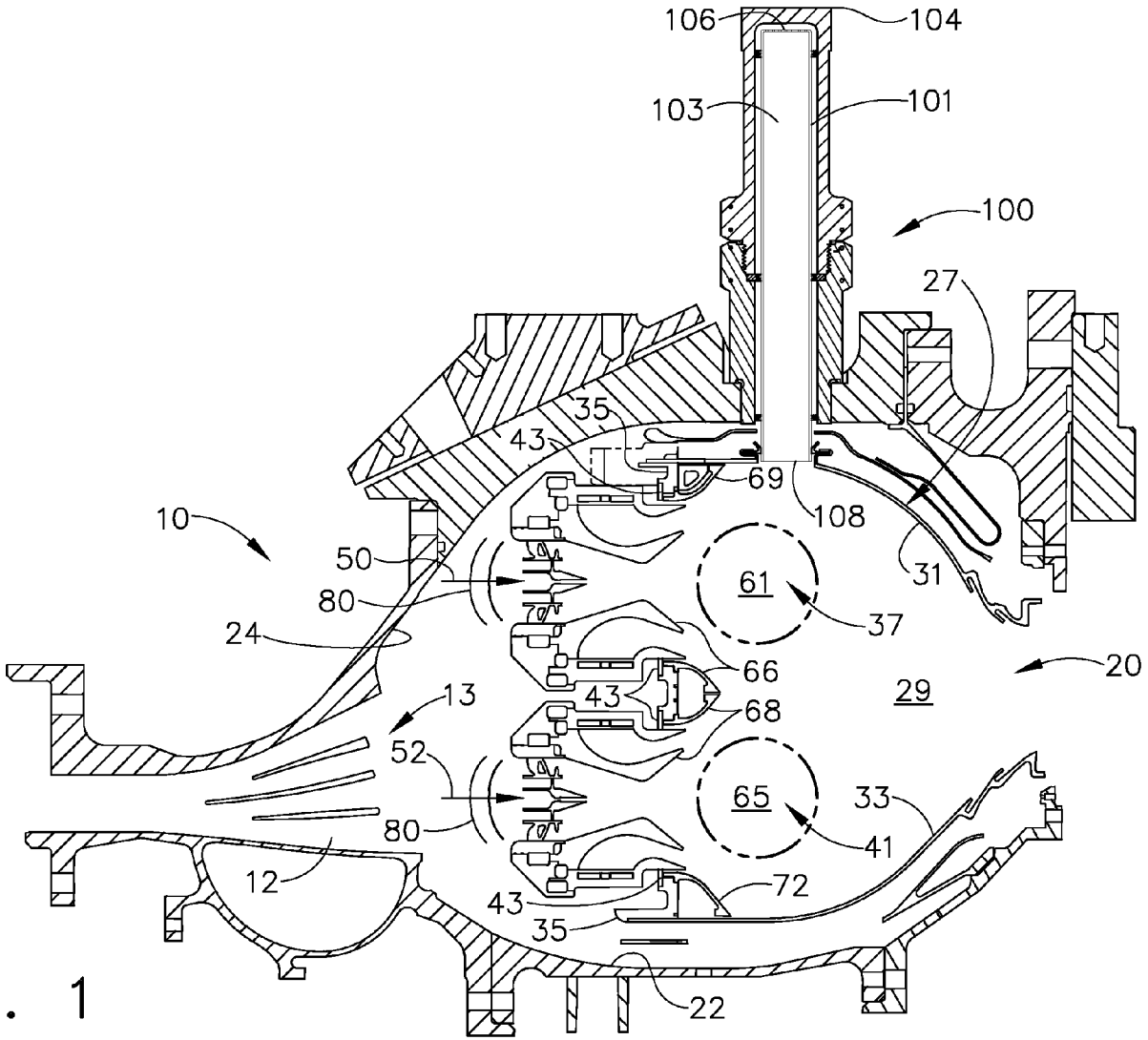
FIG. 1 is a cross-sectional illustration of an exemplary gas turbine engine combustor.

Referring now to the drawings in detail, wherein identical numerals indicate the same elements throughout the figures, FIG. 1 illustrates a combustion section or combustor 10 disposed between a diffuser 12, the diffuser 12 having a diffuser outlet 13 which is downstream of a stage of compressor outlet guide vanes (not shown), and a stage of turbine inlet guide vanes (not shown) having a turbine inlet 20. The combustor 10 is of the type suitable for use in a gas turbine engine and in particular for a low NOx marine/industrial gas turbine engine. Combustor 10 is a dual annular combustor designed to produce low emissions as described in more detail in U.S. Pat. No. 7,059,135 and published US Application 20070256418. The combustor 10 has an inner casing 22 spaced radially inward of an outer casing 24 between which is disposed a hollow body 27 defining a combustion chamber 29 therein. The hollow body 27 is generally annular in form and includes an outer liner 31, an inner liner 33, and a domed end referred to, in the industry, as a dome 35. It should be understood, however, that the technology described herein is not limited to such an annular configuration and may well be employed with equal effectiveness in a combustion apparatus of the well known cylindrical can or cannular type. Moreover, while the technology described herein is shown as being utilized in a dual annular combustor, it may also be utilized in a single or triple annular design or others as they are developed.

More specifically, as described in U.S. Pat. No. 7,059,135 and published US Application 20070256418, dual annular combustor 10 includes an outer dome 37 and an inner dome 41. Air/fuel carburetion of fuel, which is injected into the combustor by fuel injectors (not shown), is accomplished by outer and inner fuel/air mixers 50 and 52 respectively which are correspondingly disposed in openings 43 of outer dome 37 and inner dome 41, respectively. Heat shields 66 and 68 are provided to segregate the individual primary combustor zones 61 and 65, respectively. Items 69 and 72 are heat shields and are the same component as heat shields 66 and 68, respectively. The function of the conical heat shields is explained in published US Application 20070256418.

It will be understood that dynamic pressure pulses or acoustic pressure oscillations associated with the operation of combustor 10 impose excessive mechanical stress on the gas turbine engine. For example, acoustic pressure oscillations identified by the numeral 80 originate in the individual primary combustor zones 61 and 65, respectively and are reflected off the stage of turbine inlet guide vanes 18 back upstream through the relatively open flow swirl mixers 50 and 52. Acoustic pressure oscillations travel upstream through the diffuser 12 and are reflected off of the stage of compressor outlet guide vanes, thus establishing a feedback loop which produces the dynamic pressure or acoustic oscillations. This has, among several undesirable effects, the effect of cracking heat shields 66 and 68. One of the reasons that this dynamic pressure or acoustic oscillation effect appears to be so strong is the short compact design of the combustor 10. The current trend in gas turbine combustor design towards low NOx emissions required to meet federal and local air pollution standards has resulted in the use of premixed combustion systems, wherein fuel and air are mixed homogeneously upstream of the flame reaction region using the relatively open flow type of swirl mixers 50 and 52 which establishes a feedback loop which in turn permits the acoustic oscillations or their pressure waves to bounce back and forth between the stage of turbine inlet guide vanes and the stage of compressor outlet guide vanes, essentially unimpeded, and through the entire length of the combustor 10. The fuel-air ratio or the equivalence ratio at which these combustion systems operate are much "leaner" compared to conventional combustors to maintain low flame temperatures to limit the gaseous NOx emissions to the required level. Although this method of achieving low emissions without the use of water or steam injection is widely used, the combustion instability associated with operation at low equivalence ratio also creates unacceptably high dynamic pressure oscillations in the combustor resulting in hardware damage and other operational problems. To this end the technology described herein, an apparatus 100 for suppressing or attenuating the pressure pulses from acoustic pressure oscillations 80 within combustor 10 was developed. The apparatus 100 has been found to be effective when positioned downstream of (on the "hot side" of) the fuel/air mixers 50 and 52.

Figure 2:
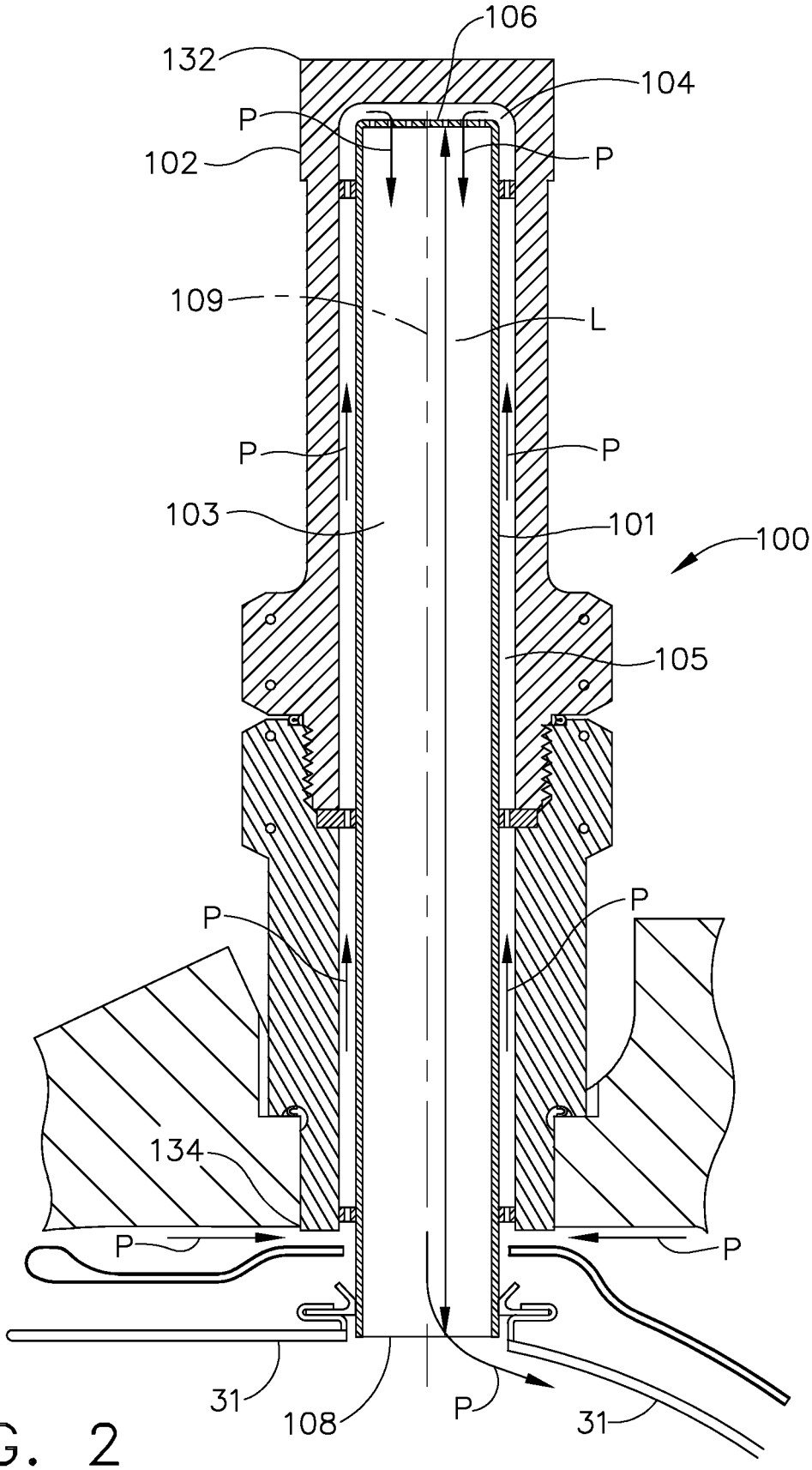
FIG. 2 is an elevational cross-sectional view of the acoustic pressure oscillation attenuation apparatus shown in FIG. 1.

The apparatus 100 has a quarter wave resonator preferably, but not necessarily, in the form of a resonating tube 101 surrounding a resonator cavity 103 as is more clearly illustrated in FIG. 2. Referring now with more particularity to FIGS. 2, 3, 4, and 5, the resonating tube 101 is enclosed within outer shell 102 and is closed at a first end 104 by a flat reflecting end cap 106 and open at a second open end 108 and has a characteristic length L as measured along a centerline 109 of the tube 101 that reflects waves 180 degrees out of phase with the incoming waves off of the end cap. The rapid movement of air into and out of the resonator cavity 103 during dynamic pressure oscillations creates dissipative losses (viscous and eddy losses) which, in conjunction with the quarter wave resonating tube 101, provides maximum dissipation at the interface. Therefore the acoustic energy contained in the incident wave is attenuated resulting in lower dynamic pressures in the combustor. The open end 108 is essentially flush with the inside surface of the outer liner 31. Accordingly, open end 108 is in alignment with an opening in the outer liner 31 of the combustor 10, such that the resonator cavity 103 is in fluid communication with the interior of the combustor 10. Outer shell 102 has a distal end 132 and a proximal end 134, proximate to the combustor 10. The resonating tube 101 operates somewhat better when straight but may slightly bent for installation purposes. A bent tube 101 reduces the profile of the apparatus 100 thereby making it easier to package and mount on the engine.

Figure 3:
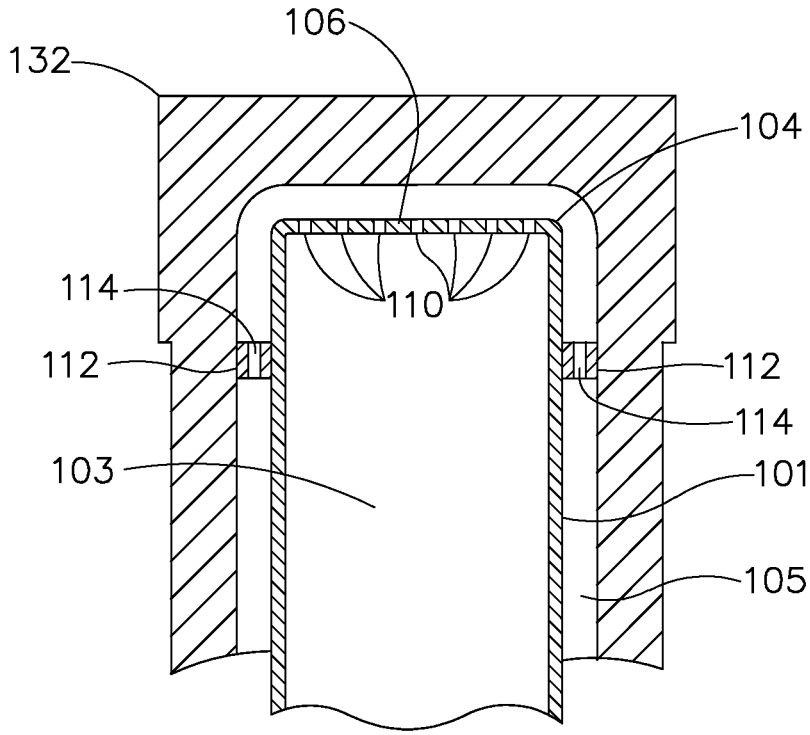
FIG. 3 is an elevational partial cross-sectional view of the distal end of the apparatus shown in FIG. 2.

As shown in FIG. 3, the end cap 106 includes one or more apertures 110, which serve a function to be described hereafter. The apparatus 100 also includes one or more spacers 112, each including one or more apertures 114, which maintain the tube 101 in spaced apart relation to the outer shell 102. If spacers 112 do not extend fully around the perimeter of the space between tube 101 and the outer shell 102, then apertures 114 may not be required as their functionality would be served by the discontinuous span of the spacers 112.

Returning to FIG. 2, the space 105 between tube 101 and shell 102 is in fluid communication with a source of pressurized air P. Where the tube 101 and shell 102 are both hollow cylindrical forms, the space 105 is annular in nature. The source may be a comparatively higher pressure region within the gas turbine engine, such as a T3 or other stage of a compressor within the engine, or other suitable source of air at the requisite temperature and pressure, and available in adequate volume. Pressurized air P freely flows through cavity 105 and enters cavity 103 via apertures 110, thereby purging gases within cavity 103 and carrying them outward through open end 108 and into the combustor 10. Apertures 114 in spacers 112 facilitate the flow of pressurized air P throughout the space 105.

Figure 4:
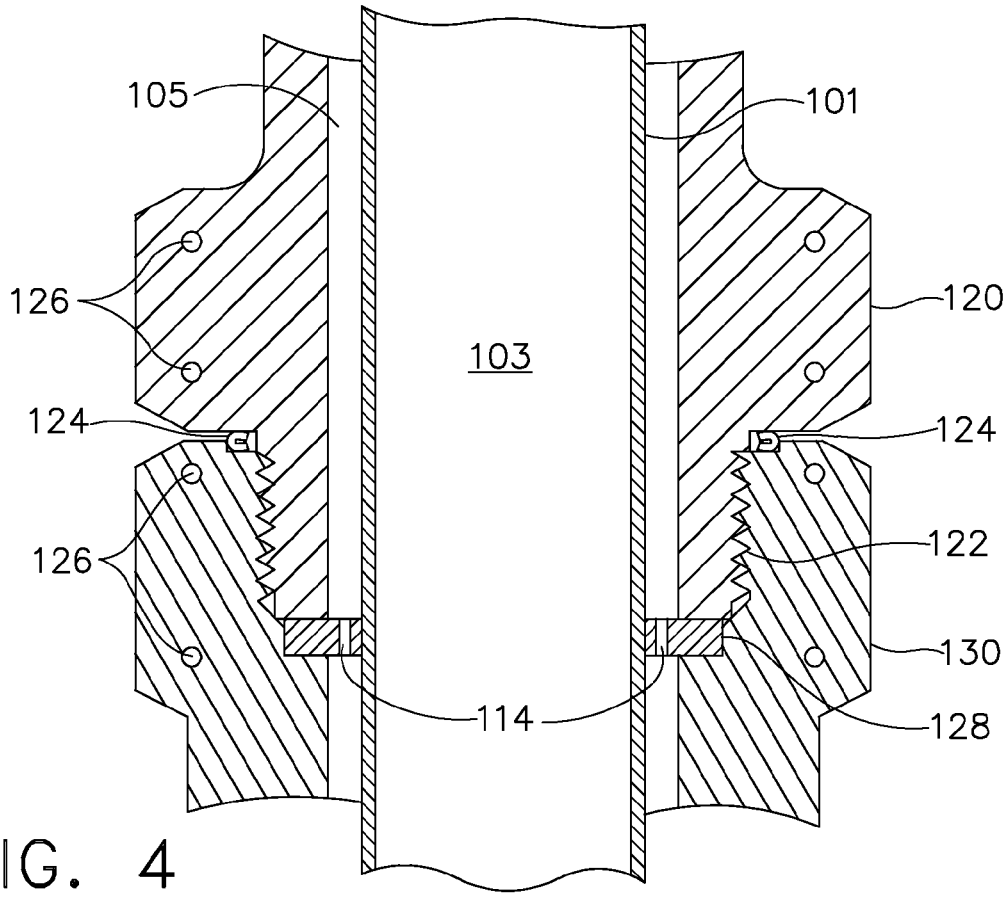
FIG. 4 is an elevational partial cross-sectional view of the intermediate portion of the apparatus shown in FIG. 2.
Figure 5:
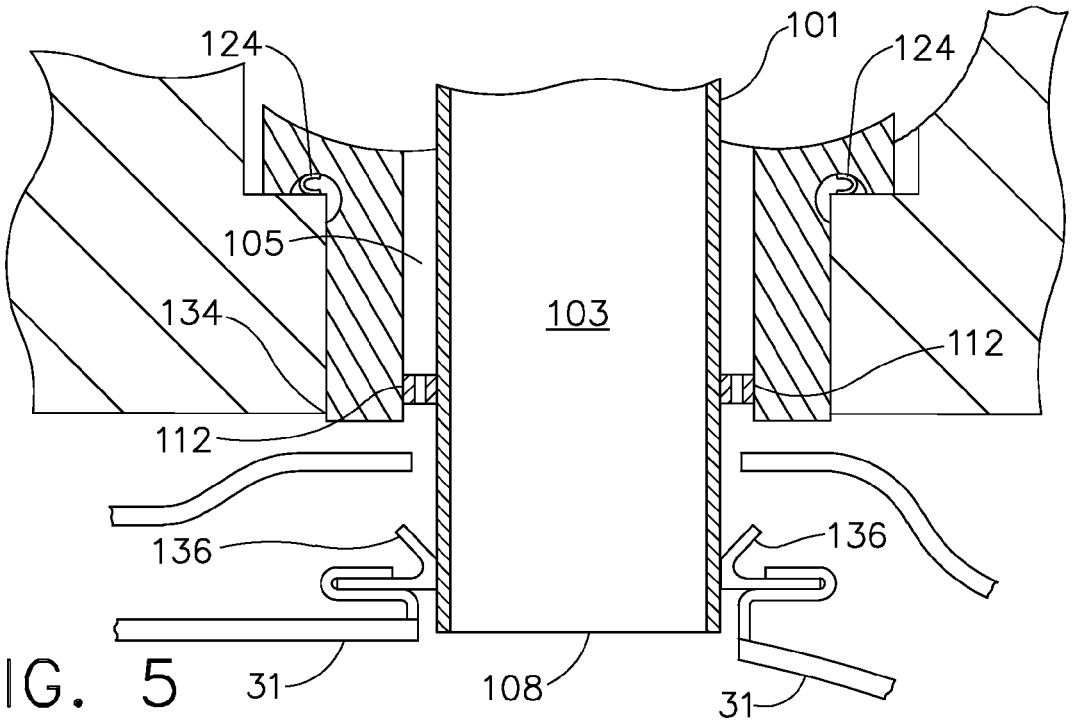
FIG. 5 is an elevational partial cross-sectional view of the proximal end of the apparatus shown in FIG. 2.

FIG. 4 illustrates construction details of the shell 102, which includes an outer or distal portion 120 and an inner or proximal portion 130, which are suitably joined to one another via connection 122. Connection 122 may take any suitable form, such as a threaded connection as shown in FIG. 4, with adjoining portions 120 and 130 including hex flat features or other suitable shapes to enable the use of tools to remove the distal portion 120 to service or replace tube 101. Apertures 126 may be provided to permit the use of lockwire or other suitable means to ensure that portions 120 and 130 remain engaged. Seals 124 may be provided to seal the joint between portions 120 and 130. Item 128 is a ring brazed or otherwise suitably affixed to tube 101. The purpose of this ring is to provide a means to hold tube 101 in connection 122. Holding the tube in this fashion limits the deflection of the tube when excited by the acoustic waves. One of the significant design challenges for this configuration was ensuring the natural frequency (of the mechanical deflection) of tube 101 is not coincident with the frequency of the acoustic wave inside the tube. By holding the tube in multiple places, its natural frequency is changed and the mechanical deflections are limited. Apertures 114 may be included as described above.

Where the tube 101 meets the outer liner 31, and open end 108 aligns with an aperture through outer liner 31, the tube 101 may be retained in position by any suitable means as shown in FIG. 5. Item 136 is a ferrule that provides a close (not tight) fit around tube 101 in order to limit the amount of air that enters the combustor through the space around the tube.

Depending upon the installation details, operating environment, and mechanical design considerations, and other such factors, other variations of the technology described herein may be developed to deliver the benefits with slightly different structural configurations. For example, it may be desirable to eliminate the outer shell 102 in favor of a thicker and/or more robust tube 101 and thereby eliminate the additional structural elements as well as the pressurized purge air P. Alternatively, in such a configuration without an outer shell 102, pressurized air P may be introduced into the interior 103 of the tube 101 through one or more apertures near the open end 108 near the outer liner 31. Other such variations may be utilized as well.

Designing the characteristic length L is very important and is best accomplished using semi-empirical methods well known in the art to determine the wavelength of the acoustic pressure oscillations 80 which are to be attenuated. Determining which frequencies must be attenuated is usually done by a combination of past experience, empirical and semi-empirical modeling, and by trial and error. The exemplary embodiment of the technology described herein illustrated in the FIGS. is for a General Electric LM6000 DLE (dry low emission) gas turbine engine for which it has been found that a problem with acoustic pressure oscillations 80 exist in a frequency range of about 400-700 Hertz (Hz). The following formulas illustrate the calculation of the characteristic length L.

$$f=C/\lambda=C/4L$$

$$L=C/4f$$

f=oscillation frequency, HZ

C=Acoustic speed of sound in air contained within the tube, in ft/second

λ=wavelength of the acoustic pressure oscillations, in ft

L=Characteristic Length, in ft.

An Example of the calculation for air temperature=500 degrees F., c=1510 Ft/sec

The characteristic length L required to attenuate 425 HZ oscillation=1510/(4.times.425)=0.89 ft=10.7"

While much of the discussion has focused on an aviation derivative gas turbine engines, it is foreseeable that the apparatus described herein may be suitable for use in other environments, such as aviation gas turbine engines.

While the invention has been described in terms of various specific embodiments, those skilled in the art will recognize that the invention can be practiced with modification within the spirit and scope of the claims.

What is claimed is:

1. An apparatus for attenuating acoustic oscillations of a gas flow contained in part by a combustor wall of a gas turbine engine combustor, said combustor including at least one air/fuel mixer, said apparatus comprising:

at least one resonating tube with a closed end and an open end and a single cavity between said ends, said tube being enclosed within an outer shell having a hollow cylindrical form and being located on said combustor wall downstream of said air/fuel mixer and forming a passive damper tuned to provide the desired attenuating effect by tuned resonance via a characteristic length L determined by the wavelength of the acoustic pressure oscillations to be attenuated.

2. An apparatus in accordance with claim 1, wherein said open end aligns with an opening in said combustor wall.

3. An apparatus in accordance with claim 1, wherein said cavity is in fluid communication with the interior of said combustor.

4. An apparatus in accordance with claim 1, wherein said tube has a hollow cylindrical form.

5. An apparatus in accordance with claim 1, wherein said tube and said outer shell define a space therebetween, said space being in fluid communication with a source of pressurized air.

6. An apparatus in accordance with claim 5, wherein said closed end includes at least one aperture to permit pressurized air to enter said cavity.

7. An apparatus in accordance with claim 1, wherein said outer shell includes inner and outer portions joined by a connection.

8. An apparatus for attenuating acoustic oscillations of a gas flow contained in part by a combustor wall of a gas turbine engine combustor, said combustor including at least one air/fuel mixer, said apparatus comprising:

at least one resonating tube with a closed end and an open end and a single cavity between said ends, said tube being enclosed within an outer shell having a hollow cylindrical form and being located on said combustor wall downstream of said air/fuel mixer and forming a passive damper tuned to provide the desired attenuating effect by tuned resonance via a characteristic length L determined by the wavelength of the acoustic pressure oscillations to be attenuated;

wherein said open end aligns with an opening in said combustor wall and said cavity is in fluid communication with the interior of said combustor.

9. A combustor for a gas turbine engine disposed between a diffuser outlet downstream of a compressor outlet guide vane stage and a turbine inlet guide vane stage, said combustor comprising:

an outer casing spaced apart from an inner casing and a combustion chamber therebetween, a combustor inlet at the diffuser outlet and a combustor outlet at the turbine inlet, an annularly disposed plurality of air/fuel mixture injectors radially disposed between said casings and axially disposed between said combustor inlet and said combustor outlet, and an annularly disposed plurality of resonating tubes disposed around said combustion chamber, each of said tubes being enclosed within an outer shell having a hollow cylindrical form and comprising;

a closed end and an open end and a single cavity between said ends, and forming a passive damper tuned to provide the desired attenuating effect by tuned resonance via a characteristic length L determined by the wavelength of the acoustic pressure oscillations to be attenuated;

wherein said annularly disposed plurality of resonating tubes is axially disposed between said plurality of air/fuel mixture injectors and said combustor outlet.

10. A combustor in accordance with claim 9, wherein said open end aligns with an opening in said combustor wall.

11. A combustor in accordance with claim 9, wherein said cavity is in fluid communication with the interior of said combustor.

12. A combustor in accordance with claim 9, wherein said tube has a hollow cylindrical form.

13. A combustor in accordance with claim 9, wherein said tube and said outer shell define a space therebetween, said space being in fluid communication with a source of pressurized air.

14. A combustor in accordance with claim 13, wherein said closed end includes at least one aperture to permit pressurized air to enter said cavity.

15. A combustor in accordance with claim 9, wherein said outer shell includes inner and outer portions joined by a connection.

16. A combustor in accordance with claim 9, wherein said combustor is a dual annular combustor.

* * * * *

UNITED STATES PATENT AND TRADEMARK OFFICE

CERTIFICATE OF CORRECTION

PATENT NO. : 8,567,197 B2
APPLICATION NO. : 12/347959
DATED : October 29, 2013
INVENTOR(S) : Mueller et al.

It is certified that error appears in the above-identified patent and that said Letters Patent is hereby corrected as shown below:

In the Specification

In Column 5, Lines 2-3, delete "cavity 105" and insert -- space 105 --, therefor.

Signed and Sealed this
Fourth Day of March, 2014

Michelle K. Lee

Michelle K. Lee
*Deputy Director of the United States Patent and Trademark Office*